United States Patent [19]

Ono et al.

[11] Patent Number: 4,698,835

[45] Date of Patent: Oct. 6, 1987

[54] X-RAY TUBE APPARATUS

[75] Inventors: Katsuhiro Ono, Kawasaki; Tatsuya Sakuma, Yokohama; Hiroshi Takahashi, Tokyo, all of Japan

[73] Assignee: Kabushiki Kaisha Toshiba, Kawasaki, Japan

[21] Appl. No.: 739,101

[22] Filed: May 30, 1985

[30] Foreign Application Priority Data

May 31, 1984 [JP] Japan ..... 59-111905
Nov. 27, 1984 [JP] Japan ..... 59-248619

[51] Int. Cl.[4] ..... H01J 35/06
[52] U.S. Cl. ..... 378/136; 313/453
[58] Field of Search ..... 378/136; 313/341, 453

[56] References Cited

U.S. PATENT DOCUMENTS

| | | | |
|---|---|---|---|
| 2,597,817 | 5/1952 | Poitteuin | 378/136 |
| 2,836,747 | 5/1958 | Atlee | 378/136 |
| 2,919,323 | 12/1959 | Riley et al. | 313/341 |
| 2,921,214 | 1/1960 | Broad | 313/453 |
| 3,631,289 | 12/1971 | Perry et al. | 378/136 |
| 4,035,685 | 7/1977 | Jacob . | |
| 4,126,805 | 11/1978 | Randall . | |
| 4,344,011 | 8/1982 | Hayashi et al. | 313/453 |

FOREIGN PATENT DOCUMENTS

| | | | |
|---|---|---|---|
| 2727907 | 1/1979 | Fed. Rep. of Germany | 378/136 |
| 2536583 | 5/1984 | France . | |
| 57-34632 | 2/1982 | Japan . | |
| 0165353 | 9/1984 | Japan | 378/136 |

OTHER PUBLICATIONS

Patent Abstracts of Japan, unexamined applications, E Section, vol. 4, No. 109, Aug. 6, 1980.
Patent Abstracts of Japan, unexamined application, E Section, vol. 6, No. 72, May 7, 1982.

*Primary Examiner*—Janice A. Howell
*Assistant Examiner*—David Porta
*Attorney, Agent, or Firm*—Cushman, Darby & Cushman

[57] ABSTRACT

An X-ray tube apparatus is disclosed, which comprises a vacuum envelope and, an anode target and a cathode assembly both disposed in the envelope and facing each other. The cathode assembly includes a filament for emitting an electron beam, filament supports for supporting the filament and a beam shaping electrode for passing through the electron beam from the filament and focusing the electron beam. The filament has a flat sheet-like electron emission portion, a pair of U-shaped portions provided at the opposite ends of the electron emission portion, in such manner that they extend from the opposite ends in the direction away from the anode target and bend back toward the anode target, and a pair of supported end portions each extending from the U-shaped portions.

8 Claims, 23 Drawing Figures

X-RAY TUBE APPARATUS

BACKGROUND OF THE INVENTION

This invention relates to an X-ray tube apparatus and, more particularly, to an X-ray tube apparatus having a rotating anode X-ray tube.

Generally, an X-ray tube apparatus is employed for X-ray examinations of patients for medical purposes. The X-ray tube apparatus that is used for such medical purposes as the examination of the stomach has a rotating anode X-ray tube. The rotating anode X-ray tube has a vacuum envelope, in which a cathode assembly and an anode target are hermetically accommodated. The anode target has a target disk. The target surface of the target disk and the cathode assembly are disposed in such a manner that they are off-set from the axis of the vacuum envelope and that they oppose each other. The target disk is connected in a rotor in the vacuum envelope. In operation, the rotor is driven by electromagnetic induction that is produced by a stator disposed outside the vacuum envelope.

The cathode assembly of the rotating anode X-ray tube noted above has a focusing electrode having a focusing dimple. A tungsten coil filament which can emit electrons is provided at the bottom of the focusing dimple. Usually, the focusing electrode is kept to the same potential as that of the filament. Electrons emitted from the filament are focused on the target surface by a focusing field that is formed in the focusing dimple by a high potential applied to an anode target.

In this cathode assembly, however, the coil filament partly projects into the focusing dimple of the focusing electrode. This arrangement is adopted so that the tube current is kept within the limitted temperature range of the tube and the projecting portion thereof in the focusing dimple has an effect of intensifying the neighboring electric field. With the protruding portion of the filament an equipotential surface in the vicinity thereof protrudes toward the target surface at a central part of the filament. Electrons emitted substantially from the side walls of the filament are directed sidewise of the focusing dimple due to a electric field produced in a zone between a bottom portion of the focusing dimple and the protruding portion of the filament into the focusing dimple, while also they are directed toward the center of the dimple due to a field in the vicinity of the open end of the focusing dimple. Therefore, electrons emitted from the side walls of the filament and those emitted from the central portion of the filament cannot be focused on the same spot. More specifically, the loci of electrons emitted from opposite side walls of the filament cross one another considerably before they reach the target. Therefore, there results a double-humped electron density distribution over the target surface area where substantially all the emitted electrons are focused with respect to the axis of the electron beam.

With the cathode assembly of the above structure, therefore, the electrons emitted from the filament cannot be focused on a sufficiently small spot on the target by the focusing electrode. In order to obtain a sufficiently small focal spot on the target surface, it is necessary to use a filament having a small size. Such a small size filament, however, requires an increased operating temperature to obtain a sufficiently high density of emitted electrons. The prior art X-ray tube, therefore, has problems in respect of the limitation of the tube current.

Further, electrons impinged on the target is not equal to each other in the progressive directions thereof, so that it is impossible to obtain a sufficiently small focal spot and a desired electron density distribution, that is, it is impossible to obtain a sufficiently high resolution.

In order to overcome the above difficulties, it is designed to employ a flattened filament. The use of such a filament is disclosed in Japanese Laid-Open No. 68056/1980 (or No. 13658/1982).

In the disclosed X-ray tube, a filament in the form of a flat strip is used. This filament has a flat central portion serving as electron emission section and a pair of leg portions. These leg portions are provided at the ends of the flat central portion (or meandering portion), the leg portions being bent at right angles from the ends. The leg portions are supported with supports. It is heated directly by an electric current passed through it, so that it emits electrons from its central portion.

However, the filament is elevated to a high temperature by the current passed through it, so that its central portion, i.e., electron emission section, is greatly deformed, i.e., curved outwardly toward the target surface, due to its thermal expansion. This deformation of the filament results in a great deviation of the focal point of electrons emitted from the central portion of the filament on the target surface.

Further, the leg portions of the filament are also deformed outwardly. This means that changes in the filament temperature change the position of the electron emission section of the filament in the direction of the tube axis, thus changing the positional relation between the focusing dimple of the focusing electrode and electron emission section of the filament. This would greatly change not only the shape of the electron beam spot on the target surface but also the width of the electron beam and the amount thereof reaching the target surface. These variations are undesired from the stantpoint of accurate control of the resolution or amount of X rays.

Meanwhile, United States Pat. No. 4,126,805 discloses an X-ray tube provided with means for preventing the displacement of the electron emission surface. The disclosed displacement prevention means, however, has a very complicated structure.

SUMMARY OF THE INVENTION

An object of the invention is to provide an X-ray tube apparatus, which has a filament having an improved shape so that the position of an electron emission portion of the filament relative to the position of a beam shaping electrode is not changed even with a change in the temperature of the filament, thus permitting an optimum focal area of an electron beam to be continuously maintained on a target.

The X-ray tube apparatus according to the invention comprises a vacuum envelope and an anode target and a cathode assembly both disposed in the envelope and facing each other. The cathode assembly includes a filament for emitting an electron beam, filament supports for supporting the filament and a beam shaping electrode for focusing an electron beam from the filament and passing through the beam shaping electrode. The filament has a flat sheet-like electron emission portion for emitting an electron beam, a pair of U-shaped portions extending from the opposite ends of the electron emission portion in the direction away from the anode target and each having a U-shaped end, and a pair of supported end portions each extending from the other end of each of the U-shaped portions. The end portions of the filament are secured to the filament supports.

DETAILED DESCRIPTION OF THE PREFERRED EMBODIMENTS

Now, one preferred embodiment of the invention will be described with reference to FIGS. 1 through 8. In this embodiment, the invention is applied to an X-ray apparatus having a rotating anode X-ray tube for examining the breast, for instance, and operable with an anode voltage of 30 kV, a maximum anode current of 20 mA and an X-ray beam spot diameter range of 50 μm to 1 mm.

Figure 1:
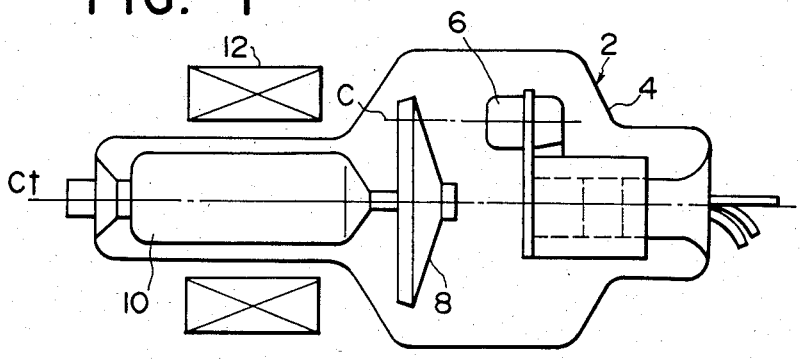
FIG. 1 is a schematic view showing a rotating anode X-ray tube in an X-ray tube apparatus according to the invention.

Referring to FIG. 1, there is shown a rotating anode X-ray tube 2. The rotating anode X-ray tube 2 has an envelope 4. A cathode assembly 6 is hermetically sealed in the envelope 4 and jointed to one end thereof. The cathode assembly 6 is disposed such that its axis is not coincident with the axis of the envelope 4. A target disk of an anode target 8 is disposed in the envelope 4 such that it opposes the cathode assembly 6. A rotor 10 is coupled to the target disk, and its end opposite the target disk is hermetically jointed to the other end of the envelope 4. The rotor 10 is driven by electromagnetic induction produced by a stator 12 disposed outside the envelope 4.

The rotating anode X-ray tube 2 having the above construction is accommodated in a housing (not shown) of the X-ray apparatus.

The structure of the cathode assembly 6 in this rotating anode tube 2 will now be described in detail with reference to FIGS. 2 through 5. The cathode assembly 6 includes a directly-heated cathode filament 20 which is mounted on a pair of filament supports 30. The cathode filament 20 consists of a flat strip, e.g., a tungsten strip with a width Dc of approximately 2 mm (see FIG. 3) and a thickness of approximately 0.03 mm. The filament 20 may be made of a high-melting alloy, e.g., lanthanum-molybdenum as well as pure tungsten.

Figure 2:
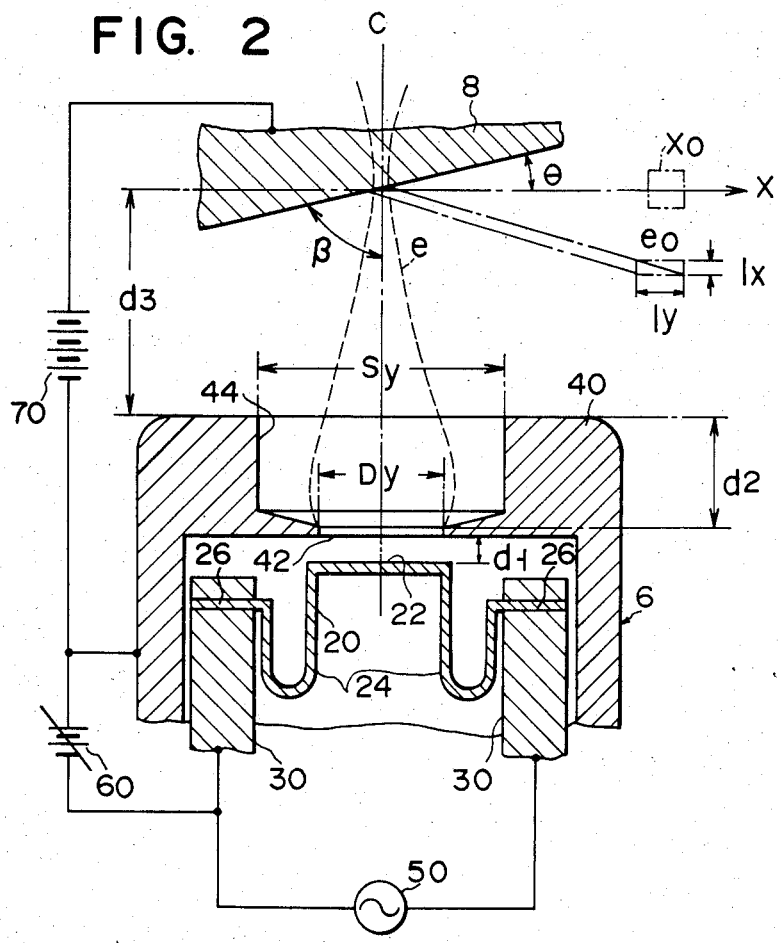
FIG. 2 is a sectional view taken in a radial plane of the rotating anode tube shown in FIG. 1 and including the axis C of an electron beam, showing a target and a cathode assembly.
Figure 3:
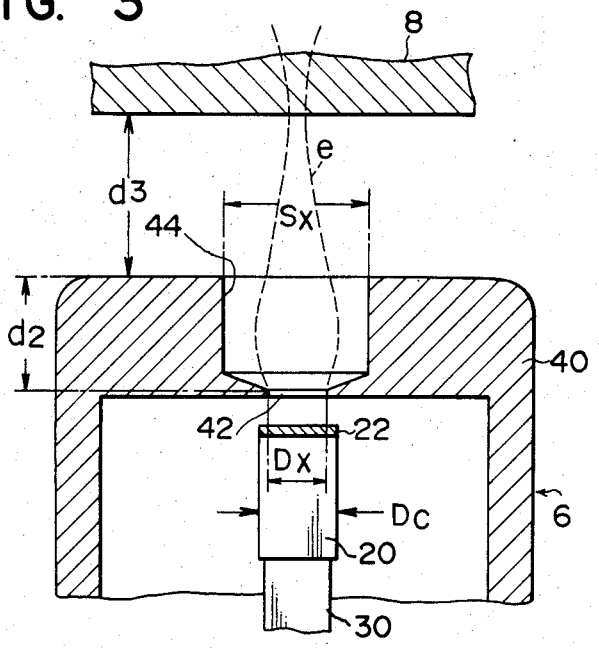
FIG. 3 is a sectional view taken along a plane perpendicular to the plan including both the center axis C of the electron beam in FIG. 1 and the axis Ct of the X-ray tube, showing the target and cathode assembly shown in FIG. 2.

As shown in FIGS. 2 and 3, the filament 20 has a flat electron emission portion 22, from which electrons are emitted when the filament is energized. The electron emission portion 22 terminates at the opposite ends in U-shaped portions 24 extending at right angles from it. Each U-shaped portion 24, includes a U-shaped end which is furthest from the electron emission portion 22 in the direction of the central beam axis C and terminates at and opposite to the electron emission portion 22 in a L-shaped supported end portion 26, which extends at right angles to the U-shaped portion 24, i.e., parallel to the electron emission portion 22. The supported end portions 26 are mounted in and electrically connected to the respective filament supports 30.

Figure 23:
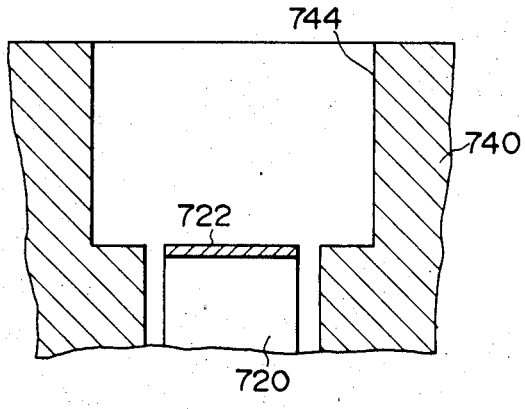
FIG. 23 is a fragmentary sectional view showing the filament shown in FIG. 2 assembled in a focusing electrode of a prior art X-ray tube.

In order to permit effective increase of the temperature of and obtain uniform temperature distribution in the electron emission portion 22 of the filament 20, the width and thickness of the U-shaped portions 24 of the filament 20 are preferably as large as possible. Denoting the distance between the electron emission portion 22 and the U-shaped end thereof opposite the electron emission portion 22 in the direction of the electron beam axis C by L1 and the distance between the supported end portion 26 and the U-shaped end thereof by L2, as shown in FIG. 23 the ratio of L2 to L1 is set to substantially 0.5 or above (e.g. 0.7).

A beam shaping electrode 40 which is like a circular cup, surrounds the cathode filament 20. The filament supports 30 noted above are secured by insulating support members (not shown) to the beam shaping electrode 40. The beam shaping electrode 40 has an electron beam limiting aperture 42 which faces the electron beam emission portion 22 of the filament 20. As is seen from FIG. 4, the electron beam limiting aperture 42 has a rectangular shape and is smaller in size than the electron emission portion 22.

Figure 4:
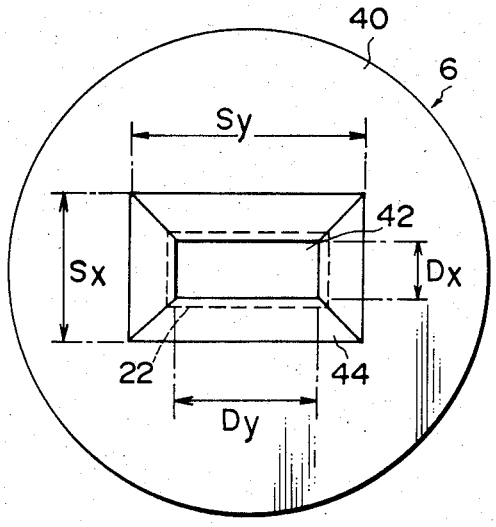
FIG. 4 is a plan view showing a beam shaping electrode shown in FIGS. 2 and 3, an electron emission portion of a filament being shown by a dashed line for the sake of comparison.
Figure 5:
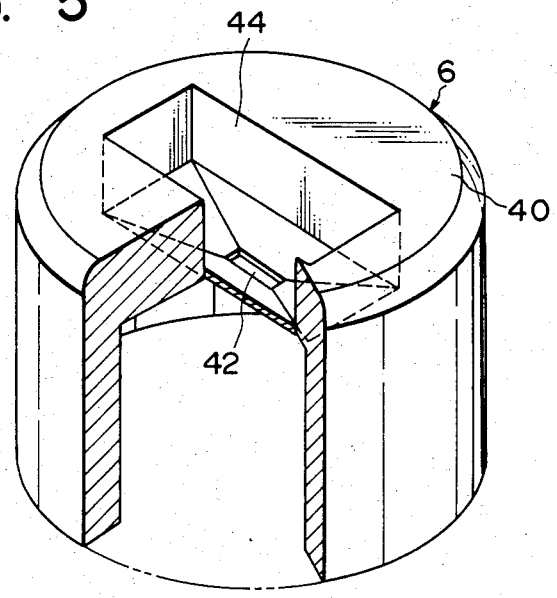
FIG. 5 is a partially broken perspective view showing part of the beam shaping electrode shown in FIG. 4.

The distance d1 between the electron beam limiting aperture 42 and the electron emission portion 22 is approximately 0.7 mm. The plane of the electron beam limiting aperture 42 on the side of the electron beam emission portion 22 is substantially parallel to this portion 22. A focusing dimple 44 is formed in the electron beam shaping electrode 40 such that it surrounds and terminates in the electron beam limiting aperture 42. The focusing dimple 44 is rectangular in shape and greater in size than the electron beam limiting aperture 42. The electron beam limiting aperture 42 and electron emission portion 22 are similar and parallel to each other, as shown in FIG. 4. The focusing dimple 44 has a sufficient depth d2, as shown in FIGS. 2 and 3. The bottom of the focusing dimple 44 is tapered toward the electron beam limiting aperture 42. The size of taper in the direction of the beam axis C is only a fraction of the depth d2.

The inventors have set the positional relation between the target surface of the anode target 8 and the electron beam limiting aperture 42 from the consideration of the apparent beam spot shape. This will now be discussed in detail. In the following discussion, $\beta$ denotes the angle between the axis C of electron beam e and the target surface of the target 8, and $\theta$ denotes the anode angle between the target surface and an X-radiation axis X, along which X-rays are directed. Further, lx and ly denote short and long sides, respectively, of a rectangular electron beam spot or actual focal area $e_0$ on the target surface. A case is now considered, in which the rectangular shape of the apparent focal area $X_0$ viewed in the direction of the X-radiation axis X is such that the ratio between the long and short sides is held at 1.4 or below, as broadly accepted in the art. Where the ratio is 1.0, the configuration of the apparent focal area is square, which is most preferable. To this end, the configuration of the electron beam impingement area of the target surface is set such as to satisfy the following formula (1).

$$\frac{ly}{lx} = \cot\theta. \tag{1}$$

Regarding the short-to-long side ratio of the actual focal area X viewed in the direction of the X-radiation axis X, it may vary up to approximately 1.4, so it may be in a range given as $$\frac{1}{\sqrt{2}} \cdot \cot\theta \leqq \frac{ly}{lx} \leqq \sqrt{2} \cdot \cot\theta. \tag{2}$$

When obtaining a minimum focal area (e.g., one with one side of 50 $\mu$m) with a predetermined tube current, the beam waist, i.e., the position at which the electron beam e has a minimum sectional area, is set to coincide with the target surface. After passing the beam waist, the electron beam e has a progressively increasing sectional area as it spreads due to mutual repulsion of its electrons. The direction of the long side of the rectangular shape of the actual focal area $e_0$ of the beam is made to coincide with the direction of the X-radiation axis X.

In order to obtain a uniform current density distribution over the actual focal area $e_0$ of the beam on the target, the configuration of the actual focal area $e_0$ of the beam is made similar to the plan shape of the beam limiting aperture 42 of the beam shaping electrode 40. In this rotating anode X-ray tube 2, it is necessary that the long and short sides of the electron beam e having passed through the rectangular electron beam limiting aperture 42 coincide, on the target surface, i.e., at the beam waist position, with the respective long and short sides of the actual focal area $e_0$. To satisfy this requirement, the dimensions of various parts of the rotating anode X-ray tube 2 are set as follows.

As shown in FIGS. 2 and 3, the depth d2 of the focusing dimple 44 is made equal for the long and short sides to facilitate production. Actually, the ratio, to the depth d2, of the distance d3 between the position of the focal point on the target 8 and the opposing surface of the beam shaping electrode 40 is set to be in a range of $\frac{1}{4}$ to 1.0. That is, the ratio of d3 to d2 is set to satisfy a relation $$1.0 \leqq \frac{d3}{d2} \leqq 4.0. \tag{3}$$

Further, the dimensional relation between the plan shapes of the beam limiting aperture 42 and focusing dimple 44 are determined as follows. In FIG. 4, in which Dy and Dx denote the long and short sides of the beam limiting aperture 42, respectively, Sy and Sx denote the long and short sides of the rectangular focusing dimple 44, respectively, P denotes the ratio Sy/Dy of the long side of the beam limiting aperture 42 to the long side of the focusing dimple 44, and Q denotes the ratio Sx/Dx of the short side of the beam limiting aperture 42 to the short side of the focusing dimple 44, the ratio of P to Q is set to be in a range given as $$0.4 < \frac{P}{Q} < 2.0 \tag{4}$$

The depth of the beam limiting aperture 42 is made as small as 1/10 or less, 1/20 or so, of the depth d2 of the focusing dimple 44.

By way of example, preferable values of the dimensions noted above in the above operating conditions are as follows.

Dx=1.2 mm, Dy=3.0 mm,
Sx=5.2 mm, Sy=6.0 mm,
d2=4.1 mm, d3=8.0 mm,
Depth of the beam limitinq aperture: 0.2 mm, $\beta$=70°, and $\theta$=20°.

Figure 6:
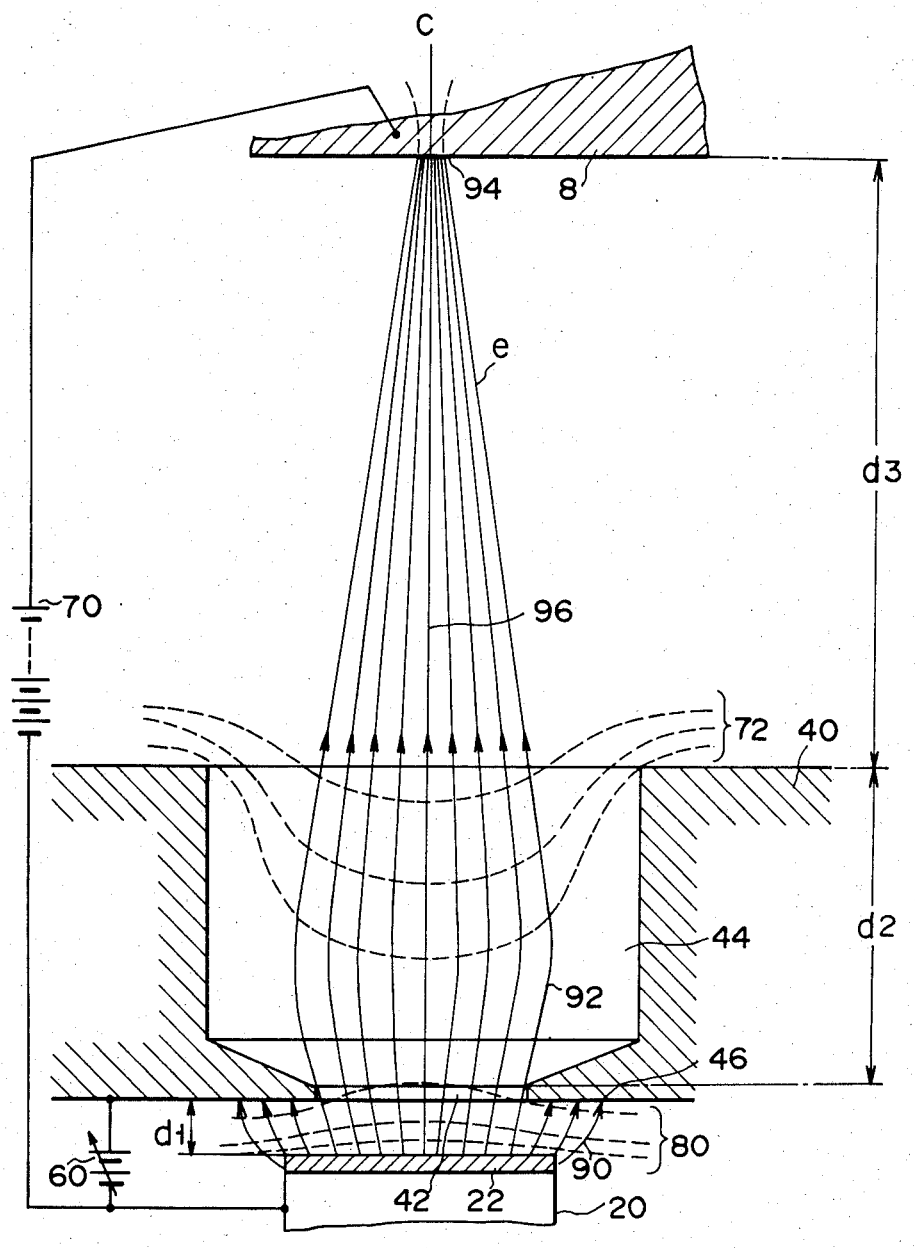
FIG. 6 is a view similar to the sectional view of FIG. 3 but also showing loci of electrons and equipotential curves for explaining the mode of operation of the rotating anode X-ray tube according to the invention.

Now, the operation of the rotating anode X-ray tube 2 of the X-ray tube apparatus according to the invention will be described with reference to FIG. 6. FIG. 6 shows the state of focusing of an electron beam in the embodiment which is based on the results of simulation using an electronic computer. FIG. 6 is a sectional view corresponding to FIG. 3. The cathode filament 20 is heated by power supplied from a power source 50, shown in FIG. 2, to it through the filament supports 30, so that electrons are emitted from the surface of the filament 20. These electrons are accelerated by the electric field produced due to the action of the bias voltage applied between the surface of the electron beam limiting aperture 42 and cathode filament 20. The electrons thus accelerated reach the electron beam limiting aperture 42.

Since the surface of the filament 20 and the opposing surface of the electron beam limiting aperture 42 are substantially parallel to each other, there are produced substantially parallel equipotential curves 80 in the zone between the two surfaces noted above. Therefore, loci of electrons passing through end portions of the electron beam limiting aperture 42 are not disturbed so much. In addition, electrons 90 that are emitted from end portions and side surfaces of the filament 20 are absorbed by the inner wall of the beam shaping electrode 40 so that they do not enter the focusing dimple 44.

Thus, only electrons emitted from a central portion of the filament 20 that are free from the fringing effect reach the anode target 8. The distance d1 between the electron beam limiting aperture 42 and the filament 20 is set such that the electrons emitted from the surface of the filament 20 may be operated by the bias voltage in a specified temperature range. For this reason, the quantity of electrons passing through the electron beam limiting aperture 42 is determined solely by the temperature of the filament 20. The electron density distribution over the anode target can be varied according to the bias voltage and independently of the current supplied. The electrons 90 that are limited by the electron beam aperture 42 will heat the inner wall 46 of the electron beam shaping electrode 40. However, the inner wall 46 gradually increases in thickness in the radially outward direction, and also it has a high thermal conductivity. Therefore, it is not locally overheated by the limited electrons 90 noted above. When the electrons form the filament pass a distance d1 through the zone between the filament 20 and beam limiting aperture 42, they experience an action of a concave lens so that they are diffused in this zone. Nevertheless, the density of electrons in the zone is very uniform. The electrons that have passed through the beam limiting aperture 42 are focused with high intensity by the focusing dimple 44, which is sufficiently deep and has a strong action of a convex lens. Both the short and long sides of the beam waist 94 of the electron beam emerging from the focusing dimple 44 are thus located on the surface, at the deeper portion, of the anode target 8.

In addition, no substantial aberration is produced in the equipotential curves 72 inside the focusing dimple 44 between the electron loci 96 in a central zone and the electron loci 92 in end zones.

Although the above description has concerned with the short side of the electron beam limiting aperture 42, as shown in FIG. 3, a similar operation is also obtained with respect to the long side of the aperture, as shown in FIG. 2.

As has been shown, only the electrons that are emitted from a central portion of the cathode filament 20 are accelerated, so that it is possible to obtain a very small sharp focal area with less aberration. In addition, electrons emitted from the side portions of the filament 20 are limited by the beam limiting aperture 42, so that no sub-focal point is formed.

A specific example of voltages applied to the target 8, beam shaping electrode 40 and filament 20 will now be described.

The filament 20 is directly heated by power supplied to it from the power source 50 through the filament supports 30. A bias voltage is applied to the beam shaping electrode 40 from a bias voltage source 60 with a variable voltage range of positive 50 to 1,000 V with respect to the filament 20. An anode voltage of approximately positive 30 kV is applied to the anode target 8 from a voltage source 70. When the bias voltage is in the neighborhood of 200 V, the position of the beam waist 94 of the electron beam e will coincide with the target surface.

Figure 7:
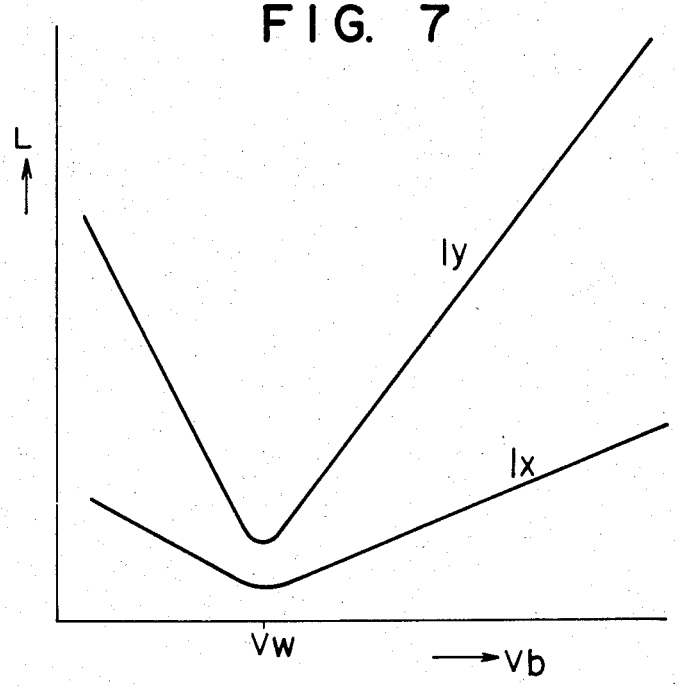
FIG. 7 is a graph showing a relationship among a bias voltage Vb and long and short side dimensions ly and lx of the focal area of an electron beam on the target surface in one embodiment of the invention.

The size L of the actual focal area $e_0$ of the electron beam on the target surface varies with the bias voltage Vb as shown in FIG. 7. When the beam waist 94 coincides with the target surface, the actual focal area $e_0$ has a short side dimension lx of approximately 50 $\mu$m and a long side dimension ly of approximately 125 $\mu$m, and the effective focal area $X_0$ of the X-ray beam viewed in the direction of the X-radiation axis X is substantially square with one side of approximately 50 $\mu$m and has a uniform electron density distribution.

Further the dimension of one side of the actual focal area $C_0$ can be varied from approximately 50 $\mu$m to approximately 1 mm without substantially changing its shape by varying the bias potential in a range of 50 to 1,000 V. Furthermore, the dimension can be controlled while maintaining optimum shape and electron density distribution by increasing the bias voltage Vb by increasing the anode current.

The long-to-short side ratio of the apparent focal area may be held within approximately 1.4.

According to the invention the cathode filament 20 is subject to less thermal deformation and the temperature of the thermion emission surface 22 is uniform, so that it is possible to ensure stable operation of the X-ray tube device.

Figure 8:
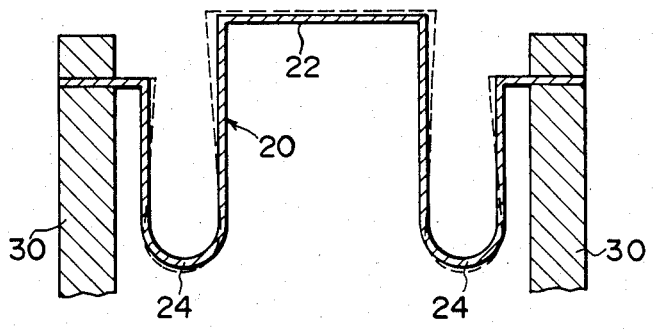
FIG. 8 is a schematic side sectional view showing a filament and filament supports shown in FIG. 2, with deformation of the filament caused by heating being shown by a dashed line.

As shown in FIG. 8, the thermal expansion of the cathode filament 20 in the direction of the flat electron emission portion 22 is substantially cancelled by a corresponding displacement of the U-shaped portions 24, that is, the flat electron emission portion 22 is not substantially displaced in the direction of the beam axis as shown by dashed line. Further, the electron emission portion 22 is not curved by its thermal expansion in the direction perpendicular to the beam axis C for the thermal expansion is absorbed by the U-shaped portions 24. Further, the electron emission portion 22 is less subject to shaking due to external vibrations. In this way, it is possible to maintain a satisfactory electron focusing characteristic at all time.

Further, by setting the ratio of the distance L2 between the U-shaped end of the U-shaped portion 24 and the support portion 26 in the direction of the beam axis C to the distance L1 between the U-shaped end noted above and the electron emission surface 22 in the same direction to 0.5 or above, the displacement of the electron emission portion 22 in the direction of the beam axis C may be held within approximately 0.04 mm. Such a filament 20 may make the cathode assembly 6 more compact when used in combination with the beam shaping electrode 40.

Figure 9:
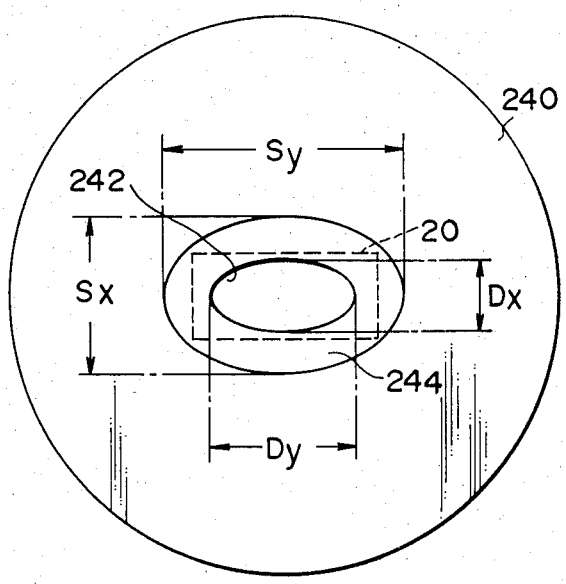
FIG. 9 is a plan view similar to FIG. 4 but showing a beam shaping electrode in another embodiment of the invention, with an electron emission portion of a filament being shown by a dashed line like FIG. 4.
Figure 10:
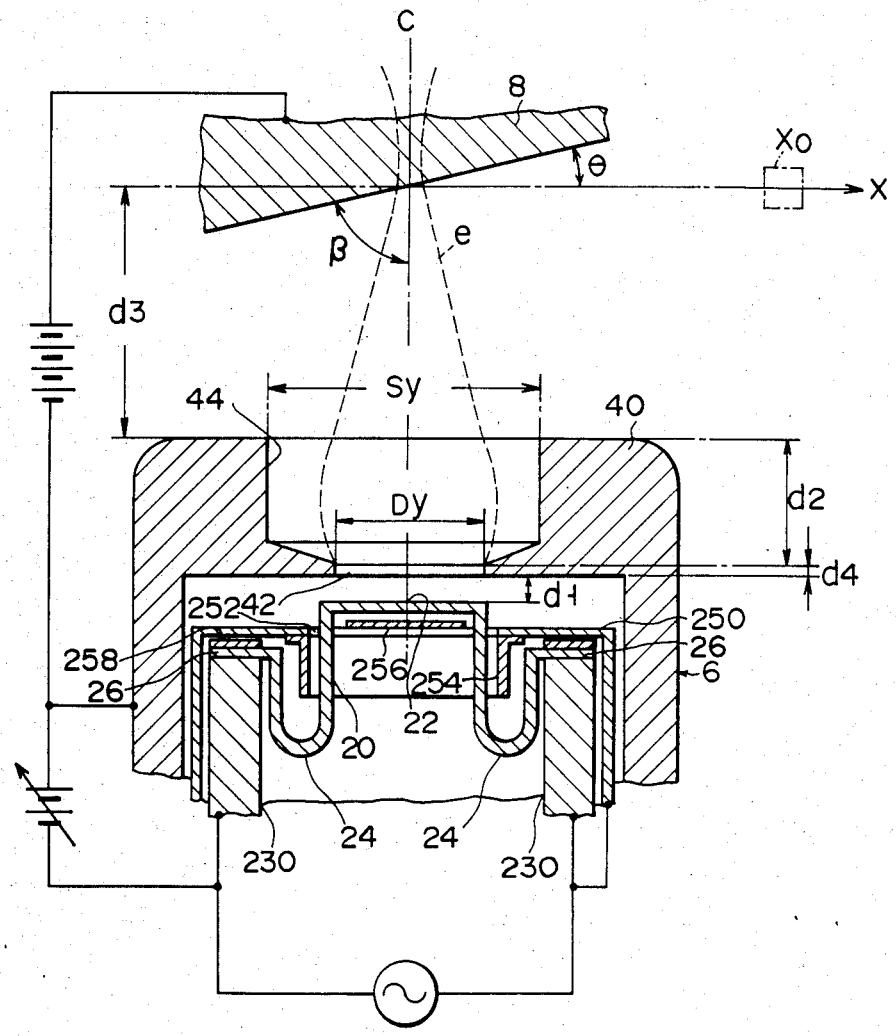
FIG. 10 is a sectional view similar to FIG. 2 but showing a target and cathode assembly of a rotating anode X-ray tube in a further embodiment of the invention.
Figure 11:
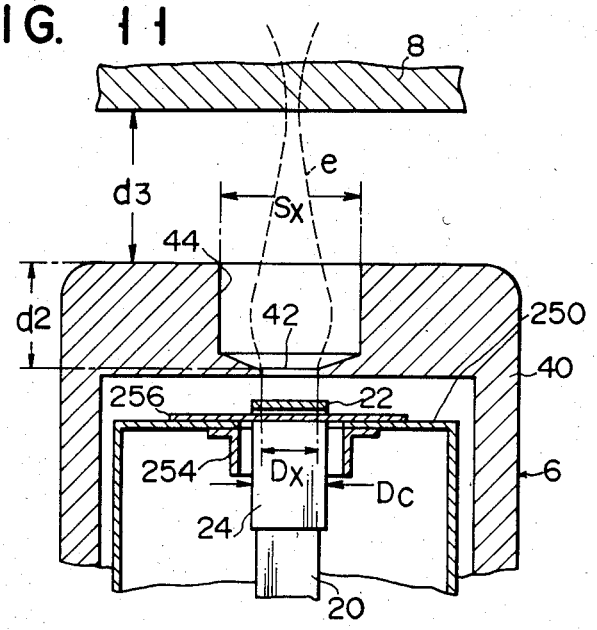
FIG. 11 is a sectional view similar to FIG. 3 but showing the target and cathode assembly shown in FIG. 10.
Figure 12:
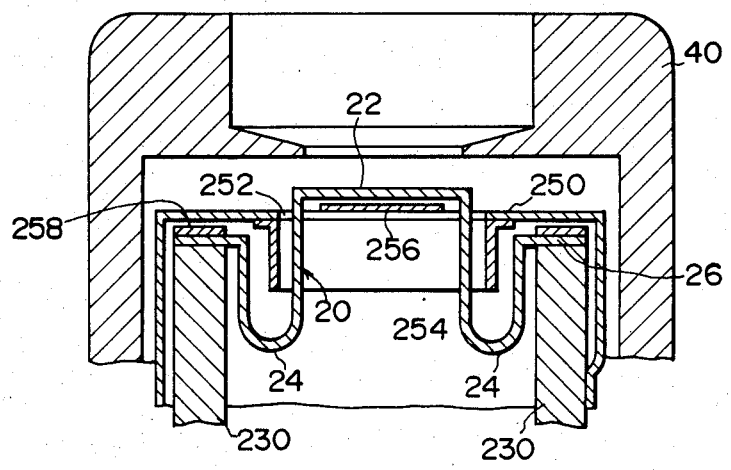
FIG. 12 is a sectional view, to an enlarged scale, showing the cathode assembly for explaining shielding members.

A second embodiment of the invention will now be described with reference to FIG. 9. Although not shown, this embodiment uses the same filament as in the preceding first embodiment.

In the preceding first embodiment, both the electron beam limiting aperture 42 and focusing dimple 44 have been rectangular in shape. In the second embodiment shown in FIG. 9, however, both are elliptical in shape. Again in this embodiment, the minor axis dimensions Dx and major axis dimensions Dy and Sy of the beam limiting aperture 242 and focusing dimple 244, respectively, are set to satisfy the relation of the formula (4) noted above. This makes it possible to to obtain the same effects as attainable in the first embodiment. In this case, the actual focal area of the electron beam on the anode target 8 is elliptical with the major axis dimension being $1/\sin\theta$ of the minor axis dimension. Therefore, the apparent focal area $X_0$ has a shape of a true circle when viewed in the direction of the X-radiation axis X of the X-ray tube 2. Further, the size of the apparent focal area $X_0$ may be varied while maintaining the true circle shape of the area by varying the bias voltage. Further, even when such conditions as bias voltage are varied, the major-to-minor axis ratio may be held substantially between $$\frac{1}{\sqrt{2}}\cdot\frac{1}{\sin\theta} \text{ and } \sqrt{2}\cdot\frac{1}{\sin\theta}.$$

Figure 13:
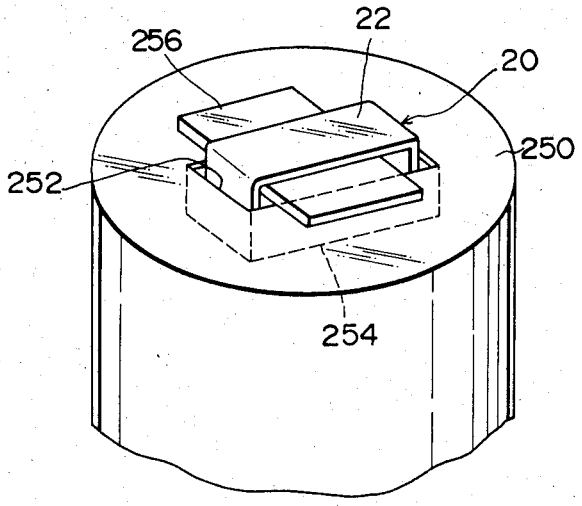
FIG. 13 is a perspective view showing a filament and shield members shown in FIGS. 10 and 11.

A third embodiment will now be described with reference to FIGS. 10 through 14. In this instance, what is different from the previous first embodiment will be described. In this embodiment, shielding members 250, 254 and 256 are disposed in the filament accommodation cavity of beam shaping electrode 40 in a positional relation to U-shaped portions 24 of filament 20 as shown in the Figures. As shown in FIG. 13, the shielding member 250 has a substantially cylindrical shape with a bottom and surrounds the U-shaped portions 24 of the filament 20 and filament supports 230. It has a rectangular hole 252, through which the electron emission portion 22 of the filament protrudes. The shielding member 254 is rectangular, and it is secured to the shielding member 250 such that it is aligned to the rectangular hole 252 and that it extends into the U-shaped portions 24 of the filament. The shielding member 256 is disposed right underneath the flat electron emission portion 22 of the filament such that it bridges the rectangular hole 252. It serves as an auxiliary shielding member for suppressing emission of electrons from the back surface of the flat filament portion 22 and also having a function of heat reflection. In this instance, substantially only the electron emission portion 22 of the filament protrudes from the shielding members 250 and 256 as is seen from FIG. 13. The shielding members 250, 254 and 256 may be electrically insulated with respect to the filament 22 and biased to a negative potential, for instance. However, they may be welded to and electrically held at the same potential as one of the filament supports 230 and also be mechanically secured via an insulating spacer (not shown) to the other filament support.

Figure 14:
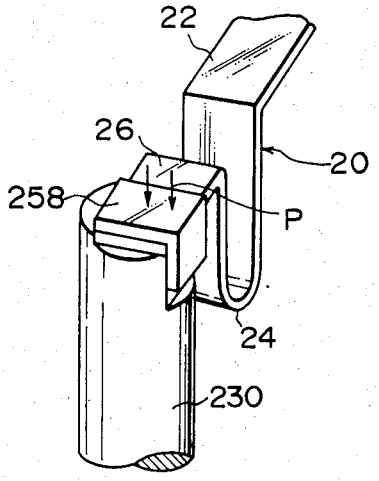
FIG. 14 is a fragmentary perspective view for explaining the joint between an end portion of a filament and a filament support shown in FIGS. 10 and 11.
Figure 15:
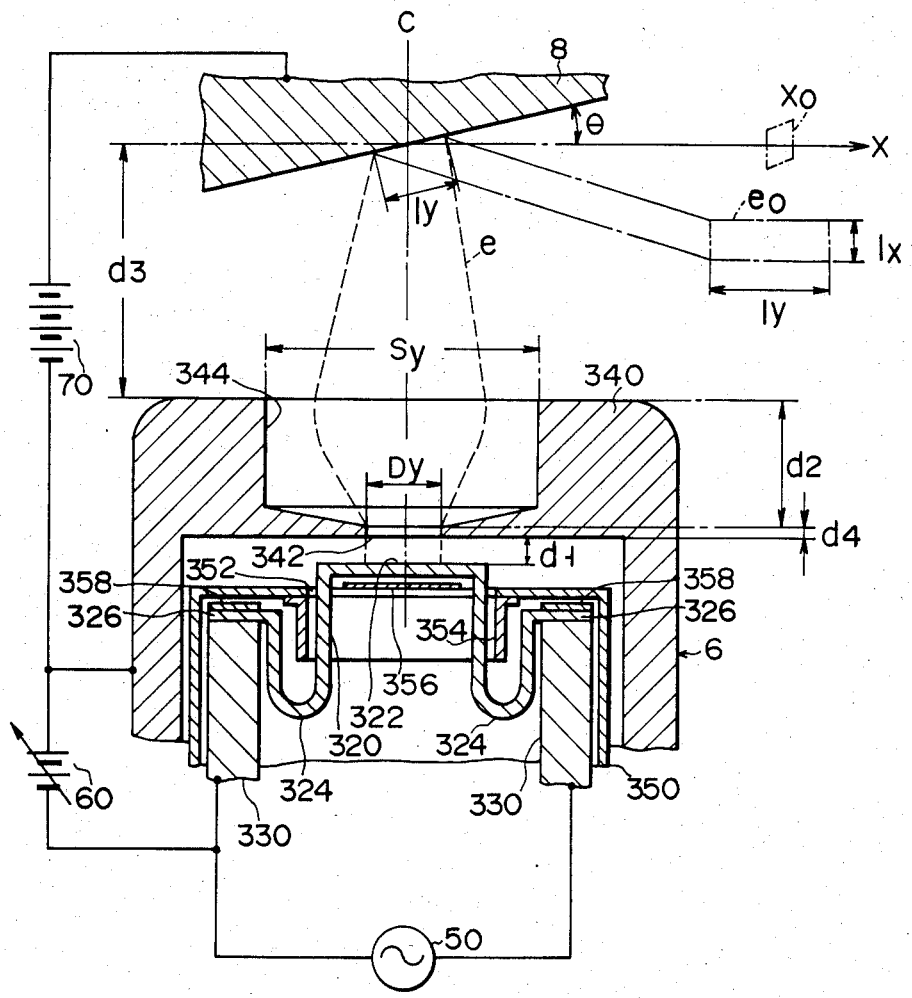
FIG. 15 is a sectional view similar to FIGS. 2 and 10 but showing a target and a cathode assembly in a still further embodiment of the invention.
Figure 16:
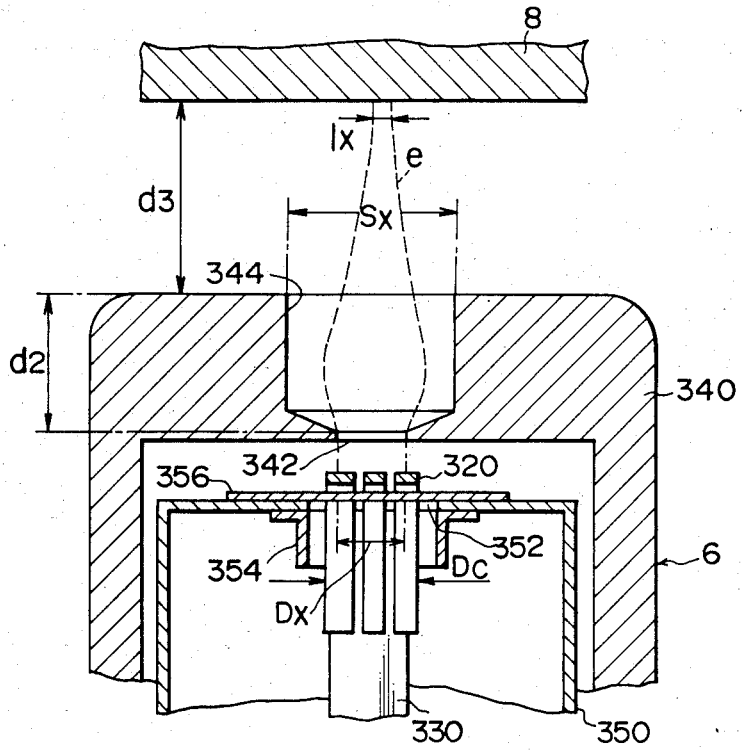
FIG. 16 is a sectional view similar to FIGS. 3 and 11 but showing the target and cathode assembly shown in FIG. 15.

FIG. 14 shows a preferred example of the joint between each end portion 24 of the filament 20 and each filament support 230. In this example, the end portion of the filament is clamped between the top of the filament support 230 and an L-shaped member 258 made of molybdenum and welded to these parts by applying electron beams or laser beams from above as shown by arrows P. This structure prevents the brittle fracture due to local fusion of the filament itself and also permits welding over a wire area.

With the cathode filament 20 having the U-shaped portions 24, the end portions 26 welded to the filament supports 20 are at a comparatively low temperature during the use of the X-ray tube, but the electron emission portion 22 and U-shaped portions 24 adjacent thereto are elevated to a substantially equal temperature, at which electrons can be emitted. However, the shielding members 250 and 252 prevent thermios about to be emitted from the other portions of the filament than the electron emission portion 22 from flowing into the inner wall of the beam shaping electrode 40 which is held at a positive potential, and also they can prevent heat radiation from the filament.

Now, a fourth embodiment of the invention will be described with reference to FIGS. 15 through 19.

In this embodiment, the invention is applied to an X-ray tube, in which the anode voltage is 120 kV, the anode current is variable between 10 and 1,000 mA and the X-ray focal area size is variable between 50 μm and 1 mm.

Figure 17:
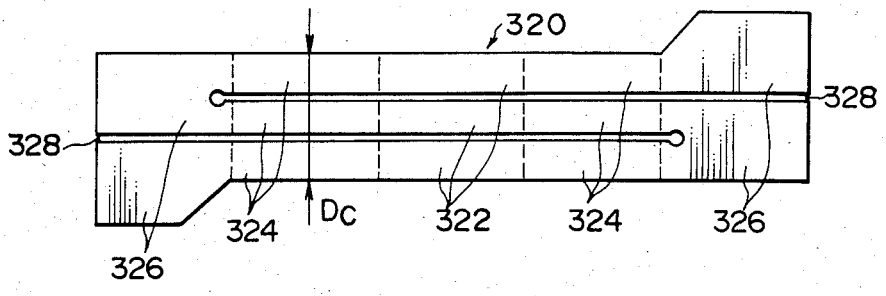
FIG. 17 is a developed plan view showing a thin sheet, from which the filament shown in FIGS. 10 and 11 is formed.
Figure 18:
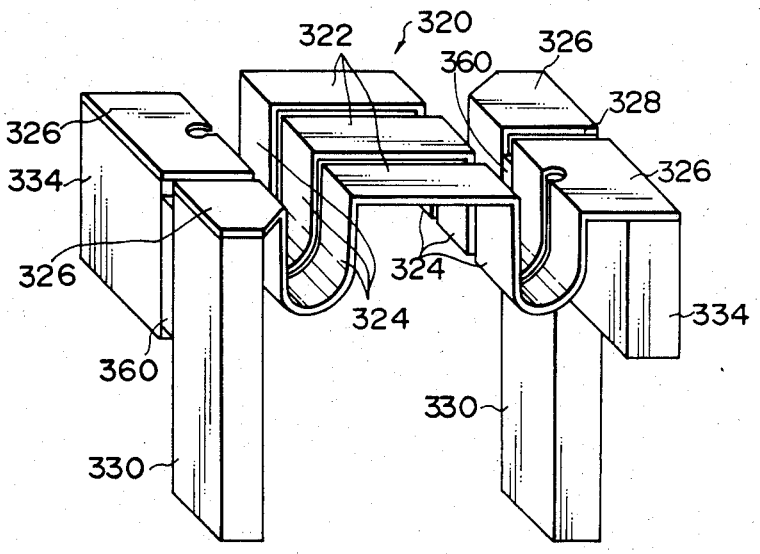
FIG. 18 is a perspective view showing the filament shown in FIGS. 10 and 11.

In this instance, filament 320 has a different structure from the filament in the previous first and third embodiments. More specifically, the filament 320 has notched portions or slits 328. The filament 320 consists of a thin sheet of a heavy metal, e.g., tungsten or tungsten alloy, having a thickness of approximately 0.03 and a width DC of approximately 10 mm. In this embodiment, the filament 320 has two slits 328, each of which extends through the filament from each end portion 326 up to the other end portion thereof. The filament 320 is formed by bending a thin strip-like sheet as shown in FIG. 17 such that it has the central flat portion 322 and a pair of U-shaped portions 324 as in the case of the first embodiment. When the filament 320 is energized and heated, the central flat portion 322 functions as electron emission surface. Insulator 360 is provided in each slit 328 of the filament 320, and each fixing block 334 is secured to each filament support 330 via the insulator 360. Each end portion 326 of the filament 320 is secured by laser beam welding to the associated filament support 330 and fixing block 334. Thus, when the filament 320 is energized and heated, it forms a series current path between the pair filament supports 330 by virture of the slits 328.

With the series connection of the filament supports 330 and notched filament 320 in the manner as described, the impedance of the cathode filament is increased, so that the filament can be operated with substantially the same orders of filament current and filament voltage as in the prior art X-ray tube. In addition, the deformation of the electron emission portion due to thermal expansion can be reduced. Further, the area of the flat electron emission surface can be increased as desired, thus permitting an increase of the quantity of electron beam. Still further, the beam shaping electrode may have a square or truely circular shape.

Figure 19:
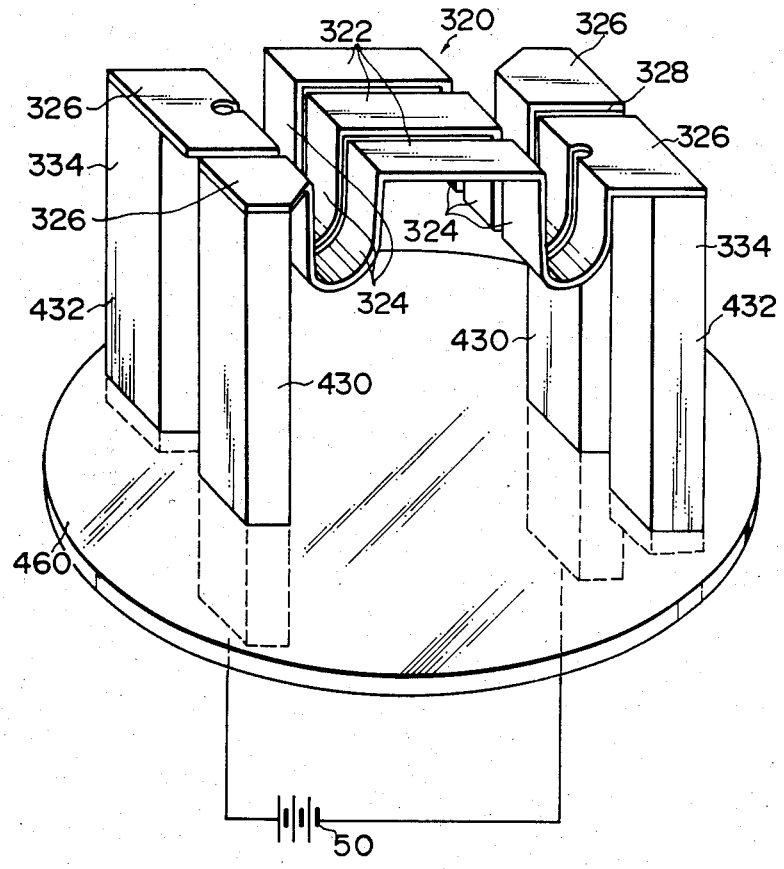
FIG. 19 is a perspective view showing a filament support structure in a still further embodiment of the invention.

FIG. 19 shows a modification of the filament support structure, on which the filament is mounted. In this instance, filament 320 has the identical shape as the filament in the preceding fourth embodiment shown in FIGS. 15 to 18. In this example, however, each end portion or support portion 326 of the filament 320 is secured to a filament support 430 and also to an auxiliary filament support 432. The pair filament supports 430 and pair auxiliary filament supports 432 are secured to a filament base 460 made of a ceramic material 460. The filament supports 430 penetrate the base 460, and their ends are electrically connected to filament power source 50. The auxiliary filament supports 432 are spaced apart from the filament supports 430, and there is no need of the insulator 360 shown in FIG. 18, that is, the auxiliary filament supports 432 are electrically insulated from the filament supports 430 by the filament base 460. Again the filament 320 forms a series current path by virture of the slits 328.

Since in this modification the pair auxiliary filament supports 432 are employed in addition to the filament supports 430 to support the end portions of the filament, the support structure is more stable. This structure permits increasing the number of slits 328 alternately extending from the opposite ends of the filament, thus increasing the number of flat electron emission portions 322 to increase the area thereof. In this case, additional auxiliary filament supports are used in correspondence to the increase of the end portions to obtain a stable filament support structure.

A fifth embodiment of the invention will now be described with reference to FIG. 20.

Figure 20:
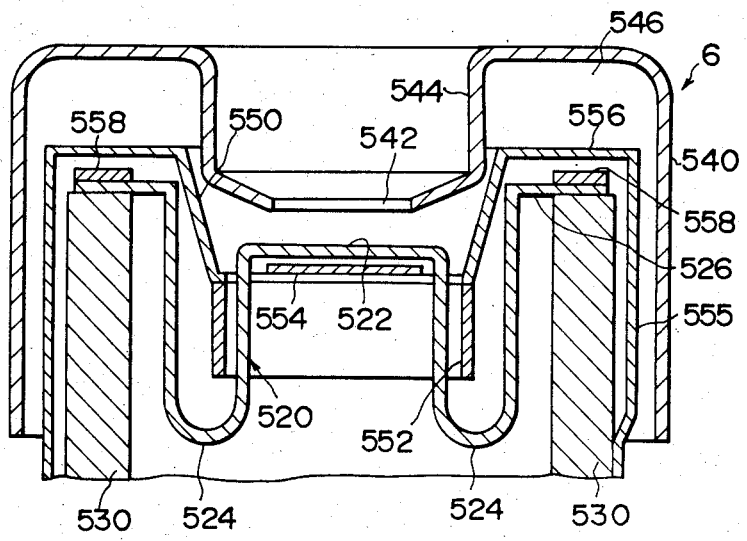
FIG. 20 is a sectional view similar to FIGS. 2 and 10 but showing a cathode assembly in a yet further embodiment of the invention.

In this embodiment of FIG. 20, beam shaping electrode 540 is press formed from a thin sheet. This beam shaping electrode 540 has a square beam limiting aperture 542 and a rectangular focusing dimple 544. It also has an inner space 546 defined by its portion facing the target, inner wall portion defining the focusing dimple 544 and outer wall portion. In the inner space 544 are found the junctures between the end portions 526 of the filament 520 and filament supports 530. In other words, the supported end portions 526 of the filament 520 are found on the side of the position of the electron emission portion 522 opposite the U-shaped ends of the U-shaped portions 524. In this embodiment, shielding member 550 has a cylindrical inner wall portion 552 surrounding a portion of the U-shaped portions of the filament, a flat portion 554 located beneath the electron emission portion 522 and a cylindrical outer wall portion 555 surrounding the filament 520 and outer side of the filament supports 530. It further has an intermediate portion 556 which is located in the inner space 546 noted above.

Figure 21:
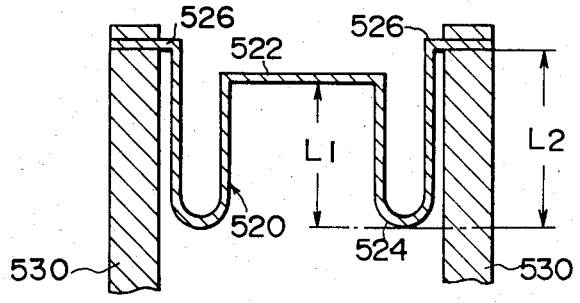
FIG. 21 is a schematic side sectional view showing a filament and filament supports shown in FIG. 20 for explaining U-shaped portions of the filament.

In this embodiment, the portions of the U-shaped portions 524 of the filament 520 that terminate in the end portions 526 have an increased length, and these extra length portions and end portions 526 extend in the inner space 546 of the beam shaping electrode 540. Thus, the space inside the beam shaping electrode 540 is utilized more effectively. In addition, the shielding member can suppress electron emission from the portions of the filament other than the flat electron emission portion. As shown in FIG. 21, the dimension L1 between the U-shaped end 524 of the filament 520 and the flat electron emission portion 522 thereof in the direction of the beam axis is smaller than the dimension L2 between the U-shaped end 524 and the end portion 526 in the same direction. When the filament 520 of this structure is heated, the portion of the U-shaped portion extending between the U-shaped end and the electron emission portion 522, i.e., the portion of the dimension L1, undergoes substantially an equal extent of thermal expansion to that of the other portion of the U-shaped portion extending between the U-shaped end and end portion 526, i.e., the portion of the dimension L2, because the former portion is at a higher temperature than the latter. Thus, there occurs substantially no displacement of the flat electron emission portion 522 in the direction of the beam axis.

Where the thickness and width of the filament 520 are uniform over the entire filament, the ratio of L2 to L1 is set to 1.5 or below. If the ratio is above 1.5, the electron emission portion 522 of the filament 520 is displaced considerably with respect to the filament supports 530 in the direction of the beam axis. From the consideration of the description made before in connection with FIG. 8 for the first embodiment, the permissible range of the ratio of the dimension L2 to the dimension L1 is from 0.5 to 1.5.

Figure 22:
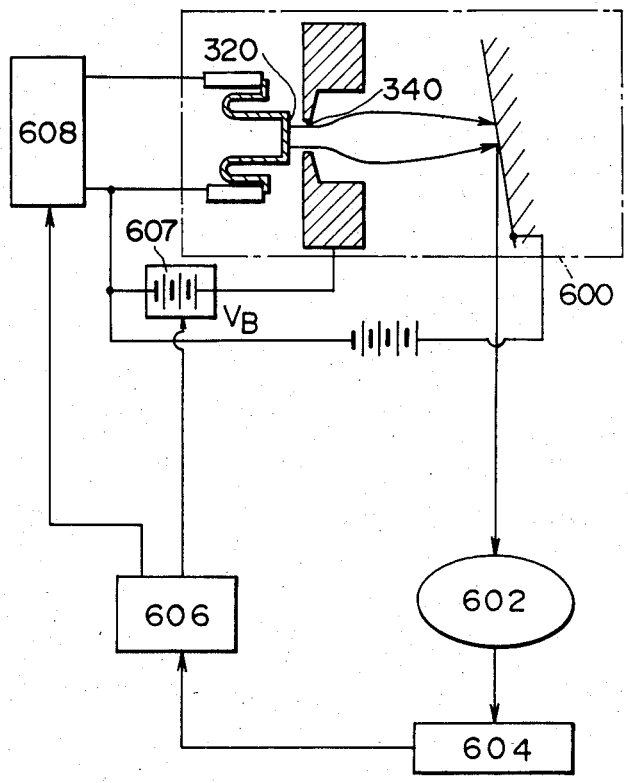
FIG. 22 is a schematic representation of a further embodiment of the X-ray tube apparatus according to the invention applied to a radiographing apparatus.

Now, an X-ray tube apparatus according to the invention, in which the bias voltage and filament current are automatically controlled, will be described with reference to FIG. 22.

In this X-ray tube apparatus, the output of an X-ray detector 604 which corresponds to the size and/or material of a subject 602 being examined, is fed to a comparator 606, and the voltage Vb of a bias voltage source 607 and the voltage of a cathode heating power source 608 are automatically determined to be in a predetermined relation to each other. In this way, optimum conditions can be automatically set for any subject.

In addition, the size of the focal area can be controlled to a desired size according to the size and/or material of the subject, and a sufficiently large tube current can be obtained for a large focal area.

In case of increasing the area and width of the electron emission portion for the purpose of increasing the anode current, the filament current is increased to correspondingly increase the voltage drop across a high voltage supply cable (not shown) which also serves as filament current supply cable. To avoid this, a step-down transformer for stepping down the voltage supplied to the filament, may be provided in or near the X-ray tube accommodation vessel.

FIG. 23 shows a sixth embodiment of the invention. In this instance, filament 720 consisting of a thin sheet and having U-shaped portions according to the invention, is disposed at the bottom of a focusing dimple 744 of a beam shaping electrode 740 of a usual X-ray tube. Again in this case, the electron emission portion 722 is not substantially displaced, so that it is possible to suppress changes in the shape of the focal area.

In the foregoing embodiments and modifications, the width DC and thickness of the U-shaped portions and end portions of the cathode filament may be greater than those of the flat electron emission section. In this case, it is possible to heat the flat electron emission portion to a comparatively high temperature and also prevent vibrations of the portion, thus ensuring stable operation.

What is claimed is:

1. An X-ray tube apparatus comprising:

a vacuum envelope having a tube axis; and an anode target and a cathode assembly disposed in said vacuum envelope and facing each other;

said cathode assembly including:

a filament having a flat sheet-like electron emission portion for emitting an electron beam, a pair of U-shaped portions provided at the opposite ends of said electron emission portion, in such a manner that they extend from the opposite ends in the direction away from said anode target and bend back toward the anode target, and a pair of supported end portions each extending from said U-shaped portion, respectively;

filament supports for supporting said supported end portions of said filament;

a beam shaping electrode for passing through an electron beam from said electron emission portion of said filament and focusing said electron beam toward said anode target;

a shielding member disposed between an inner wall surface of said beam shaping electrode and each said U-shaped portion of said filament; and an auxiliary shielding member extending from said shielding member and into a gap defined by each said U-shaped portion, said shielding member and said auxiliary shielding member being maintained at a potential substantially equal to a potential applied to said filament.

2. The X-ray tube apparatus according to claim 1, wherein said filament has at least two slits extending in opposite directions from the respective supported end portions and forming a series current path of the filament between the opposite supported end portions thereof.

3. The X-ray tube apparatus according to claim 1, wherein said electron beam has a beam axis corresponding to a central axis of said filament, each of said U-shaped portions having a U-shaped end which is farthest from said electron emission portion in the direction of the beam axis, and said electron emission portion and supported end portions of said filament are in a positional relation to said U-shaped portions of the filament such that $$0.5 \leqq L2/L1 \leqq 1.5$$

where L1 represents the distance between said electron emission portion and the U-shaped end of each said U-shaped portion in the direction of the beam axis and L2 represents the distance between each said supported end portion and the U-shaped end in said beam axis direction.

4. The X-ray tube apparatus according to claim 1, wherein the width of at least one of said U-shaped portion and said supported end portion extending from either end of said electron emission portion of said filament is at least equal to the width of said electron emission portion.

5. The X-ray tube apparatus according to claim 1, wherein the thickness of said electron emission portion of said filament is equal to or slightly smaller than the thickness of said U-shaped portions and supported end portions.

6. The X-ray tube apparatus according to claim 1, wherein said shielding member is electrically connected to one of said filament supports.

7. The X-ray tube apparatus according to claim 1, wherein said beam shaping electrode is made from a thin sheet and has a space for accommodating a portion of said shielding member and said filament supports.

8. The X-ray tube apparatus according to claim 1, which further comprises a power source for heating said filament, and in which each said supported end portion of said filament is supported by a filament support and also by an auxiliary filament support, each said filament support being electrically connected to said power source, said filament support of one said support end portion being disposed opposite to said auxiliary filament support of the other said support end portion and said auxiliary filament support of said one support end portion being disposed opposite said filament support of said other support end portion such that said filament supports and said auxiliary supports are symetrically disposed about a central axis of said filament.

* * * * *